US007007588B2

(12) United States Patent
Roy

(10) Patent No.: US 7,007,588 B2
(45) Date of Patent: Mar. 7, 2006

(54) DEVICE FOR ADJUSTING THE PRESSURE IN A HYDRAULIC JACK

(75) Inventor: Alain Roy, Buc (FR)

(73) Assignee: Goodrich Actuation Systems SAS

( * ) Notice: Subject to any disclaimer, the term of this patent is extended or adjusted under 35 U.S.C. 154(b) by 118 days.

(21) Appl. No.: 10/820,572

(22) Filed: Apr. 7, 2004

(65) Prior Publication Data

US 2004/0255772 A1 Dec. 23, 2004

(30) Foreign Application Priority Data

Apr. 9, 2003 (FR) ..... 03 04385

(51) Int. Cl.
*F15B 11/08* (2006.01)

(52) U.S. Cl. ..... 91/468; 137/118.06; 188/282.7; 188/282.8; 188/322.21

(58) Field of Classification Search ..... 188/282.7, 188/282.8, 322.21; 91/441, 468; 137/118.06
See application file for complete search history.

(56) References Cited

U.S. PATENT DOCUMENTS 6,390,254 B1 5/2002 Bennett et al.

FOREIGN PATENT DOCUMENTS

GB 2150259 6/1985
JP 11063081 A 6/1999

*Primary Examiner*—F. Daniel Lopez
(74) *Attorney, Agent, or Firm*—Blakely Sokoloff Taylor & Zafman

(57) ABSTRACT

The invention relates to a device for adjusting the pressure in the chambers of a hydraulic jack comprising a hollow valve seat extending substantially longitudinally between two end sections, the body of the valve seat being connected to a source of pressurised fluid, each of the end sections of the valve seat being linked to a chamber of the hydraulic jack and adapted to receive a valve allowing to control the refilling with hydraulic fluid of said chamber of the jack, characterised in that a valve return spring is placed inside said valve seat and in that each of the ends of said valve return spring is attached to one of said valves.

9 Claims, 3 Drawing Sheets

DEVICE FOR ADJUSTING THE PRESSURE IN A HYDRAULIC JACK

The invention relates to a device for adjusting the pressure in a hydraulic jack notably when the hydraulic jack is used as a shock absorber.

The invention relates more particularly to a device for refilling of hydraulic fluid in the chambers of a hydraulic jack used as a shock absorber.

The invention notably has, but not exclusively, its application in the field of aeronautics. In this context, the jack is employed for example as a control surface actuator and is capable of being used to ensure a damping whether that be in normal operating mode or in abort sequence.

FIG. 1 illustrates diagrammatically a standard device for adjusting the pressure in the chambers of a hydraulic jack 1 used as a shock absorber. Said hydraulic jack 1 comprises a chamber 14 filled with hydraulic fluid in which the piston 13 moves and a control rod 11 integral to said piston 13. The position of the piston 13 in the chamber 14 defines on either side of said piston 13 two chambers, Chamber1 and Chamber2, respectively to the left and to the right of the said piston 13.

The hydraulic jack 1 receives via its control rod 11 a reciprocating movement represented by the arrow 12, said hydraulic jack 1 having the role of damping said reciprocating movement. Thus, the hydraulic fluid goes from one chamber to the other passing through a restrictor 3.

An increase in pressure is thus produced in the compressed chamber by the movement of said control rod 11 and a reduction in pressure in the opposing chamber, thus known as depression chamber. If said depression chamber undergoes a major drop in pressure, a phenomenon of cavitation could occur which would not allow the hydraulic jack damping device to ensure the expected damping.

In order to avoid this phenomenon of cavitation, each of the chambers Chamber1 and Chamber2 is classically connected to a device 2 allowing to refill said jack 1 with hydraulic fluid.

A hydraulic accumulator 4 pressurises the hydraulic fluid over and above the atmospheric pressure. The then pressurised fluid circulates from said physical accumulator 4 towards the device 2. Said device 2 thus has the role of supplying with pressurised hydraulic fluid, when this is needed, the chamber Chamber1 or Chamber2 under depression.

Such as is diagrammitised in FIG. 1, said device 2 is of backstop type, the fluid can only circulate from said device 2 towards said chambers Chamber1 and Chamber2 of said jack 1.

The device 2 for the refilling with fluid of the chambers of a hydraulic jack, as for the one illustrated diagrammatically in FIG. 1, classically comprises two back flow stop valves. Said two back flow stop valves are positioned separately or placed tête-bêche in the same bore. And each back flow stop valve thus has its own spring and valve guide.

In this way, such a device for the refilling with fluid of the chambers of a hydraulic jack is cumbersome and the number of parts needed for its assembly is important. The encumbrance and complexity for the making of such a device are in particular such that notably the volume, the mass and the cost of making such a device are elevated.

A purpose of the invention is to overcome these aforementioned inconveniences.

In this regard, the invention proposes a device for adjusting the pressure in the chambers of a hydraulic jack comprising a hollow valve seat extending substantially longitudinally between two end sections, the body of the valve seat being connected to a source of pressurised fluid, each of the end sections of the valve seat being linked to a chamber of the hydraulic jack and adapted to receive a valve allowing to control the refilling with hydraulic fluid of said chamber of the jack, characterised in that a valve return spring is placed inside said valve seat and in that each of the ends of said valve return spring is attached to one of said valves.

In this way the device related to the invention needs only one spring. Moreover, the movable equipment constituted of the spring and the valves does not need to be guided. Due to the return force exercised by said spring, the valves effectively return automatically, after their lifting, on the end sections of the valve seat. The device related to the invention therefore does not use valve guides. The encumbrance of the device related to the invention is thus limited and its making is simplified.

The device related to the invention moreover prevents the circulation of hydraulic fluid from said chambers of the jack towards said valve seat, said valves thus also acting as back flow stop valves.

Preferably, the spacing of each of the valves from its attitude angle in contact with the corresponding end section of the valve seat is made from the moment a sufficient difference in pressure exists between the chamber of the hydraulic jack to which said end section of said valve seat is linked and the inside of said valve seat, in this way authorising the refilling with pressurised hydraulic fluid of said chamber of the jack.

Preferably, each of the ends of the valve return spring is attached to one of the valves substantially at its centre in a suitable manner so that the movable equipment constituted of the spring and valves does not need to be guided, said valves notably returning automatically to their attitude angle after having been spaced apart, including if said valves have not perfectly been spaced out in the axis of the valve seat.

In a non-restrictive manner, the valves used in the context of the invention are of spherical or conical span.

According to a first embodiment of the invention, a hole passes through each of the valves and each of the end sections of the spring form an end wire capable of being feed through a hole. Said end wire extends beyond the hole and is welded upon exiting the valve to allow to attach each of the ends of said spring to one of said valves.

Advantageously, an adjustment to the tension of the spring is performed, once a first end section of the spring is welded to a first valve, by puling on the other end section of the spring through the hole diametrically passing through the second valve until it reaches the desired tension load. The other end section of said spring is then welded to said second valve.

According to a second embodiment of the invention, the valves comprise a centring pin with a hole drilled out and each of the end sections of the valve return spring forms an end loop. Said end loops are received in said holes of the centring pins to allow to attach each of the ends of said valve return spring to one of said valves.

Preferably, said valves cannot be simultaneously spaced from said end sections of said valve seat, which will prevent the simultaneous filling of the chambers of said jack.

Other characteristics, purposes and advantages of the invention will appear upon reading the detailed description which follows, and upon visualising the annexed drawings, given by way of non-restrictive illustration and among which:

FIG. 1, already discussed, diagrammatically represents a device for adjusting the pressure in the chambers of a hydraulic jack used as a shock absorber;

FIG. 2 diagrammatically represents the device for refilling with fluid the chambers of a hydraulic jack related to the invention;

Figure 1:
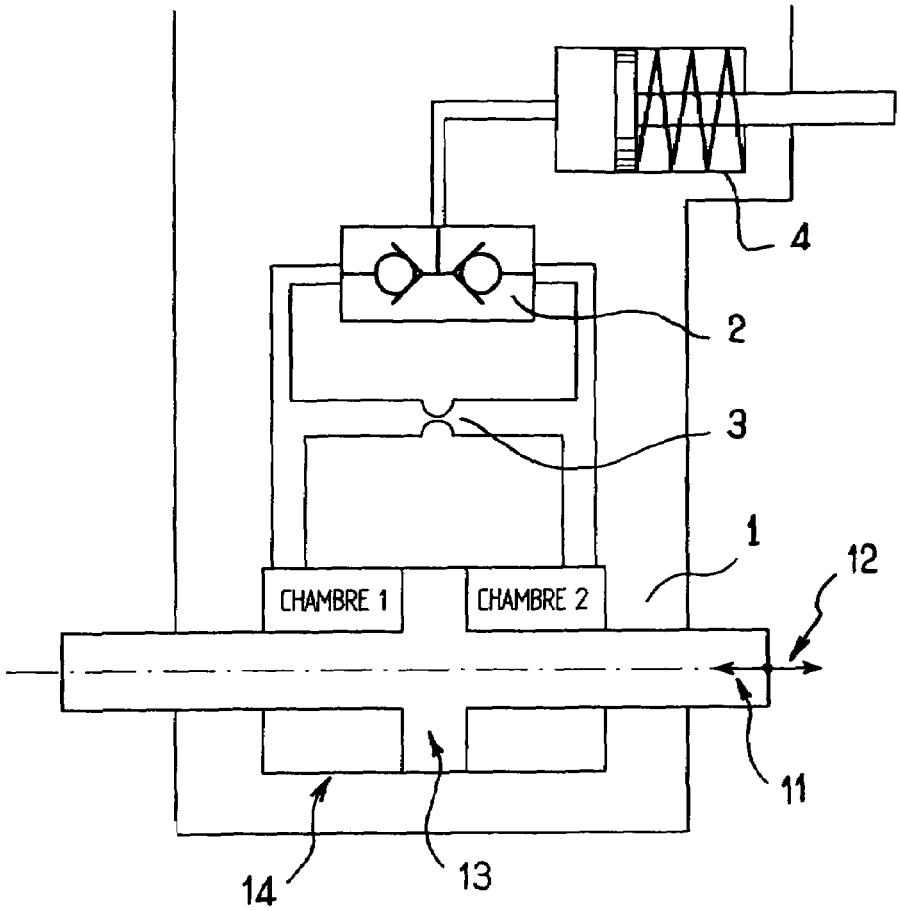
Figure 2:
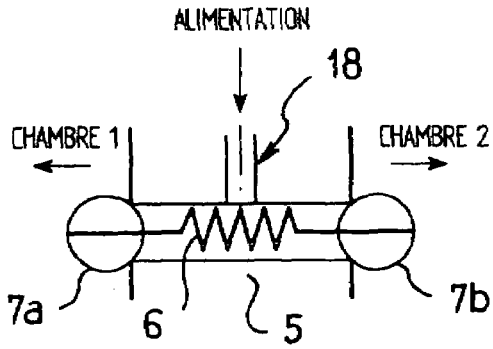

As is represented in FIG. 2, the device 2 related to the invention for the refilling with fluid of the chambers of a hydraulic jack comprises a valve seat 5 which receives the filling with fluid of the hydraulic accumulator to which it is connected via the duct 18.

Said valve seat 5 is substantially cylindrical and is filled with hydraulic fluid pre-pressurised by the hydraulic accumulator. Said valve seat 5 has at each of its end a valve seat capable of receiving a valve 7*a*, 7*b* and will for this reason be called from now on double valve seat.

The valves 7*a* and 7*b* preferably have a spherical or conical span so as to efficiently come into contact with each of the end sections of the double valve seat 5 so as to ensure the watertightness of the device related to the invention.

Each of the ends of the double valve seat 5 is connected to one of the chambers Chamber1 and Chamber2 of the hydraulic jack used as a shock absorber allowing, when it is needed, to refilling with hydraulic fluid of one of the chambers Chamber1 and Chamber2 of the hydraulic jack.

An extension spring 6 is placed at the centre of said double valve seat 5 and the valves 7*a* and 7*b* are respectively attached to each of the ends of said extension spring 6.

Advantageously, the valves 7*a* and 7*b* are pulled at their centres by each of the ends of said extension spring 6.

So that, said two valves 7*a* and 7*b* linked between them by said extension spring 6 are, in their attitude angle, fitted into their respective seats on either side of said double valve seat 5 filled with pressurised fluid. The return force exercised by the spring 6 on each of the valves 7*a* and 7*b* substantially at their centres allows to maintain said valves 7*a* and 7*b* in contact with said double valve seat 5 and to anticipate the flow of said fluid towards on of the chambers.

The extension spring 6 advantageously constitutes a valve return spring. After having been spaced apart from their attitude angle, said valves 7*a* and 7*b* effectively return automatically, due to the return force exercised by said spring 6, in attitude angle, fit into their respective seats, including if said valves were not perfectly spaced apart from the axis of said double valve seat 5. The movable equipment constituted of a spring 6 and said valves 7*a* and 7*b* do not therefore need, by construction, to be guided.

From the moment a difference in pressure between one of the chambers Chamber1 and Chamber2 of the hydraulic jack then in depression and the inside of the double valve seat 5 is sufficiently great, the valve linked to said chamber in depression moves away from its attitude angle. The spring 6 is then pulled to the side corresponding to said valve moved away from its attitude angle, exercising on the latter a return force, and the pressurised fluid in the double valve seat 5 then flows towards said chamber in depression. Once the difference in pressure has returned to normal, said valve returns, due to the return force exercised on said spring 6, to its equilibrium position in contact with the double valve seat 5 thus blocking the flow of hydraulic fluid.

Advantageously, said valves 7*a* and 7*b* cannot be simultaneously spaced apart from their attitude angle in contact with the double valve seat 5. The filling of the two chambers Chamber1 and Chamber2 can therefore not operate and a malfunctioning of the device for adjusting the pressure in the chambers of the hydraulic jack is thus prevented.

Moreover, the arranging of the parts of the device related to the invention allow to advantageously create a unit that can be tested without being definitively assembled in the apparatus to which it is intended.

Of course, the valves 7*a* and 7*b* are not only refill valves capable of allowing the circulation of fluid from said double valve seat 5 towards the chambers of the jack but also back flow stop valves capable of preventing the circulation of fluid from said chambers of the jack towards said double valve seat 5.

The following description presents in a non-restrictive manner two embodiments particular to the invention, and more precisely two embodiments of attaching the extension spring to the valves of spherical span.

Figure 3:
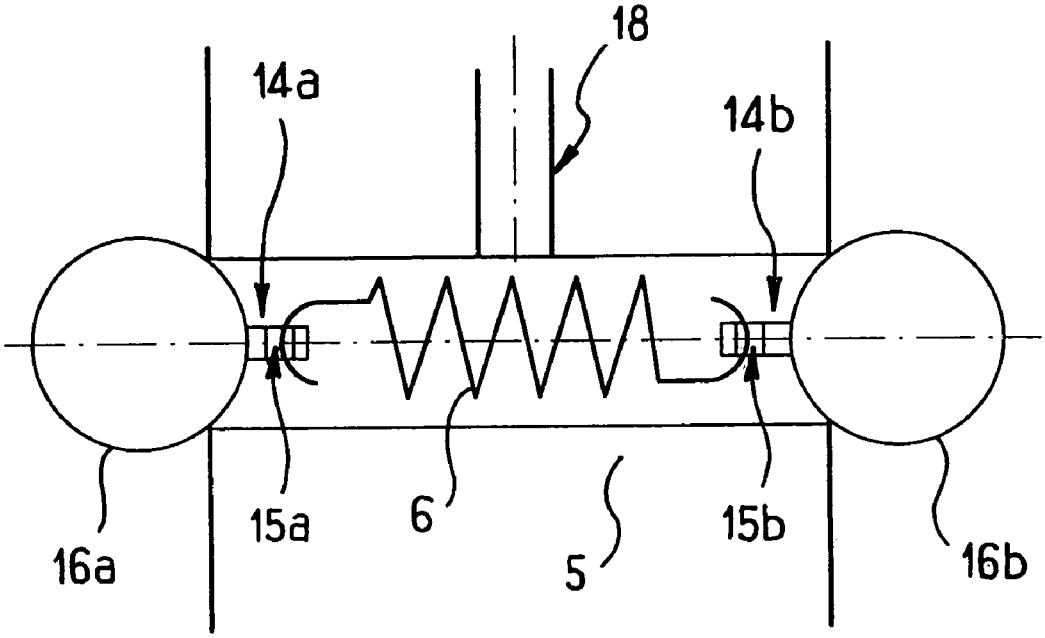
FIG. 3 illustrates a first embodiment of the attaching of the extension spring to the valves of spherical span.

FIG. 3 represents a first embodiment of attaching the extension spring 6 to the valves 16*a* and 16*b*. Each of said valves 16*a* and 16*b* respectively comprise a centring, pin 14*a* and 14*b* which extends inwardly from the double valve seat 5.

Each of the centring pins 14*a* and 14*b* is respectively drilled with a hole 15*a* and 15*b* capable of receiving an end section of the spring 6 forming an end loop. Advantageously, said spring 6 is capable of extending sufficiently to, once the first end section forming a loop received in the hole of the centring pin of a valve (for example the left side end loop of the spring 6 received in the hole 15*a* of the centring pin 14*a* of the valve 16*a*), allow to assemble the second end section forming a loop (the right side end loop in this example) with the other valve (here the valve 16*b*) and therefore the constitution of the movable equipment constituted of said spring 6 and said valves 16*a* and 16*b* in said valve seat 5.

Figure 4:
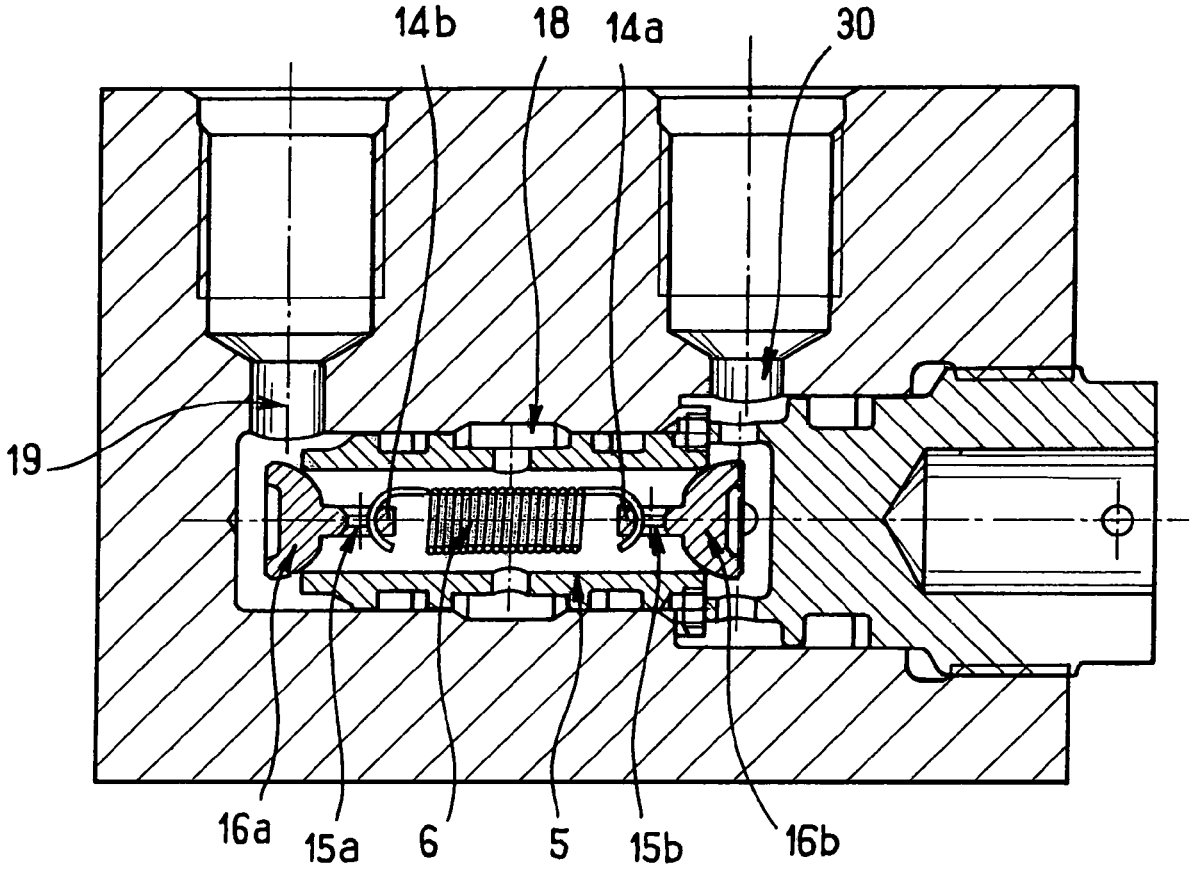
FIG. 4 represents a sectional view of a device in accordance with the invention, the attaching of the extension spring to the valves being performed in accordance with the first embodiment illustrated in FIG. 3.

FIG. 4 represents in a more detailed manner a sectional view of a device in accordance with the invention for which the attaching of the extension spring 6 to the valves 16*a* and 16*b* is performed according to the first embodiment illustrated in FIG. 3. The references 19 and 20 represent the connection of each of the end sections of the double valve seat 5 to one of the chambers of the hydraulic jack, said connection being authorised of course only when the corresponding valve is spaced apart from its equilibrium position.

Figure 5:
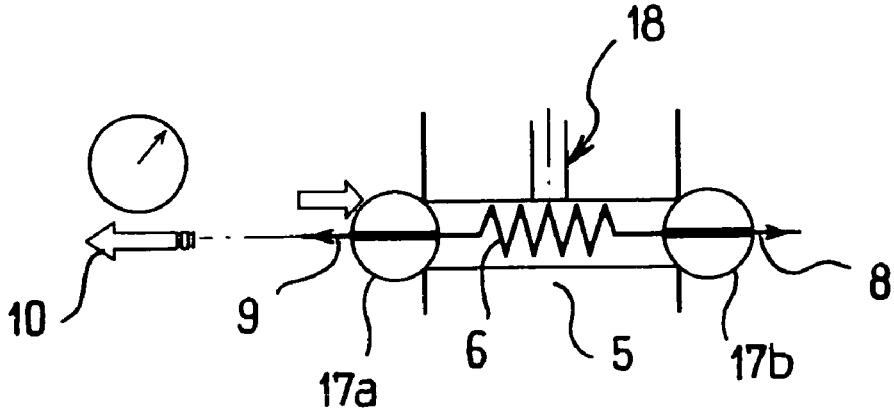
FIG. 5 illustrates a second embodiment of the attaching of the extension spring to the valves of spherical span.

FIG. 5 presents a second embodiment of attaching the extension spring 6 to the valves 17*a* and 17*b*. Each of the valves 17*a* and 17*b* is a ball drilled with a hole through its diameter. Said holes extending longitudinally in extension to the longitudinal axis of said double valve seat 5 and are capable of receiving an end section of the spring 6 forming a wire end.

Preferably, said end sections of the spring 6 forming an end wire extend beyond the balls forming the valves 17*a* and 17*b* and are welded upon exiting said balls forming valves 17*a* and 17*b* at the reference points 8 and 9 in FIG. 5. The sub-assembly made of the valves 17*a* and 17*b* and of the spring 6 can therefore not be disassembled.

During the welding of the end sections of the spring to the balls forming the valves, an adjustment to the tension of the spring 6 can be advantageously performed. For this purpose, a first welding is performed (welding 8 for example) on a first end section of the spring. Once this first welding has been performed, the other end section of the spring is pulled, whilst maintaining the valve on the side of the other end section of the spring in contact with the double valve seat 5 (valve 17*a* in the context of the example), until it reaches the desired tension load of the spring. The adjusting of the tension of the spring is represented in FIG. 5 by the arrow 10. The second welding (welding 9 in this example) is then done so that the sub-assembly cannot be disassembled formed of said valves 17*a* and 17*b* and of the extension spring 6. The pulling of the end section forming the end wire of the spring 6 passing through the hole in the valve with the aim of adjusting the tension of the spring advantageously allows to ensure a very precise adjusting of the valve loading.

Of course, the invention is not restricted to the particular embodiments which have just been described, but extends to any variation in accordance with its approach.

What is claimed is:

1. Device for adjusting the pressure in the chambers of a hydraulic jack comprising a hollow valve seat (5) extending substantially longitudinally between two end sections, the body of the valve seat (5) being connected to a source of pressurised fluid (18), each of the end sections of the valve seat (5) being linked to a chamber of the hydraulic jack and adapted to receive a valve (7*a*, 7*b*) allowing to control the refilling with hydraulic fluid of said chamber of the jack, characterised in that a valve return spring (6) is placed inside said valve seat (5) and in that each of the ends of said valve return spring (6) is attached to one of said valves (7*a*, 7*b*).

2. Device set forth in claim 1, characterised in that it prevents the circulation of hydraulic fluid from said chambers of the jack towards said valve seat (5), said valves (7*a*, 7*b*) thus also acting as a back flow stop valves.

3. Device set forth in either claim 1 or 2, characterised in that one of the valves (7*a*, 7*b*) is spaced apart from its equilibrium position in contact with the corresponding end section of said valve seat (5) from the moment a sufficient difference in pressure exists between the chamber of the hydraulic jack to which said end section of said valve seat (5) is linked and the inside of said valve seat (5), in this way authorising the refilling with pressurised fluid of said chamber of the jack.

4. Device set forth in either claim 1 or 2, characterised in that each of the ends of the valve return spring (6) is attached to one of the valves (7*a*, 7*b*) substantially at its centre in a suitable manner so that the movable equipment constituted of said spring (6) and said valves (7*a*, 7*b*) does not need to be guided.

5. Device set forth in claim 1 characterised in that the valves (7*a*, 7*b*) are of spherical or conical span.

6. Device set forth in either claim 1 or 2, characterised in that a hole passing through each of the valves (17*a*, 17*b*) and each of the end sections of said spring (6) forming an end wire capable of being feed through said holes, said end sections forming wire extend beyond said holes and are welded upon exiting said holes to said valves (17*a*, 17*b*) to allow to attach each of the ends of said spring (6) to one of said valves (17*a*, 17*b*).

7. Device set forth in claim 6, characterised in that an adjustment to the tension of the spring (6) is performed, once a first end section of said spring (6) forming an end wire welded to a first valve, by puling on the other end section of said spring (6) through the hole diametrically passing through the second valve until it reaches the desired tension load, said other end section of said spring (6) then being welded to said second valve.

8. Device set forth in either claim 1 or 2, characterised in that the valves (16*a*, 16*b*) comprise a centering pin (14*a*, 14*b*) with a hole (15*a*, 15*b*) drilled out and each of said end sections of said spring (6) forming an end loop, said end loops are received in the holes (15*a*, 15*b*) of said centring pins (14*a*, 14*b*) to allow to attach each of the ends of said spring (6) to one of said valves (16*a*, 16*b*).

9. Device set forth in either claim 1 or 2, characterised in that said valves (7*a*, 7*b*) cannot be simultaneously spaced from said end sections of said valve seat (5), the simultaneous filling of said chambers of said jack thus being prevented.

* * * * *

UNITED STATES PATENT AND TRADEMARK OFFICE

CERTIFICATE OF CORRECTION

PATENT NO. : 7,007,588 B2
APPLICATION NO. : 10/820572
DATED : March 7, 2006
INVENTOR(S) : Roy It is certified that error appears in the above-identified patent and that said Letters Patent is hereby corrected as shown below:

In claim #8, column 6, line 32, please delete “centring” and insert -- centering --.

Signed and Sealed this

Seventh Day of August, 2007

JON W. DUDAS
*Director of the United States Patent and Trademark Office*